United States Patent [19]

Hinz et al.

[11] 4,287,887

[45] Sep. 8, 1981

[54] OXYGEN RESPIRATOR CONTAINER FOR AN OXYGEN RELEASING CHEMICAL CARTRIDGE

[75] Inventors: Claus-Dieter Hinz, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 132,999

[22] Filed: Mar. 24, 1980

[30] Foreign Application Priority Data

Apr. 4, 1979 [DE] Fed. Rep. of Germany ..... 2913507

[51] Int. Cl.[3] ..... A62B 7/08

[52] U.S. Cl. ..... 128/202.26; 422/120; 220/408

[58] Field of Search ..... 128/202.26, 205.28, 128/206.17; 422/120, 122, 123, 126; 220/403, 404, 408, 410, 85 B

[56] References Cited

U.S. PATENT DOCUMENTS

| | | | |
|---|---|---|---|
| 114,450 | 5/1871 | Lawrence | 220/408 |
| 1,229,912 | 6/1917 | Doncaster | 220/408 |
| 2,956,562 | 10/1960 | Leffler, Jr. | 128/202.26 |
| 3,285,461 | 11/1966 | Santelli | 220/404 |
| 3,733,008 | 5/1973 | Churchill et al. | 128/202.26 |
| 3,737,287 | 6/1973 | Churchill et al. | 422/120 |
| 3,941,381 | 5/1976 | Jorgensen | 220/403 |

*Primary Examiner*—Henry J. Recla

*Attorney, Agent, or Firm*—McGlew and Tuttle

[57] ABSTRACT

An oxygen respirator container for an oxygen releasing chemical cartridge comprises a cylindrical bottom part having a bottom wall and an interior side wall with a plurality of spaced apart raised ribs with a recess between adjacent ribs. An oxygen generating cartridge is disposed in the bottom part on the bottom wall and over the ribs of the side wall and at least one holding element is disposed in the recess between adjacent ribs between the side wall in the container. The holding element has a top head portion which projects outwardly from the holding element into the bottom part and overlies the top edge of the cartridge so that it holds the cartridge over the bottom wall. The side wall of the container also includes an indented part adjacent the top of the cartridge with a top ledge of the indented part defining a holding nose. The holding element has a deflectable tab portion which engages in the indented part under the nose. The tab also includes a straight portion which is held by the cartridge substantially parallel to the side wall of the container such that the deflectable tab portion is urged into the indented part of the side wall.

7 Claims, 4 Drawing Figures

OXYGEN RESPIRATOR CONTAINER FOR AN OXYGEN RELEASING CHEMICAL CARTRIDGE

FIELD AND BACKGROUND OF THE INVENTION

This invention relates in general to oxygen respirators and in particular to a new and useful oxygen respirator container for a chemical cartridge which gives off oxygen.

Oxygen respirators contain, in a standby container, a cartridge filled with an oxygen-generating chemical, a breathing tube, and a breathing bag. Apparatus of this type are subject to great mechanical stresses. In order to avoid damage to the parts, they must be securely mounted in the standby container. This must be achieved with a minimum of weight and space, and also permit simple replacement of the chemical cartridge.

A known oxygen respirator with shuttle breathing through a breathing tube has in a standby container a cartridge connected to the breathing tube and filled with an oxygen-generating chemical, and a breathing bag secured on the side of the cartridge opposite the breathing tube connection. The standby container consists of a bottom part with a cover, between which is arranged a gasket. Both parts of the container are pressed against each other by known locking-and pressing elements, e.g. lever fasteners. The oxygen suppling cartridge has on the top side on both narrow sides each a bent-off, downward pointing support.

These supports rest on catches arranged on the upper part of the inner surface of the bottom part of the container. The cartridge is thus so held in the container that a space remains free for the breathing bag. The lateral support is effected by the narrow sides of the curved plates surrounding the cartridge jacket which bear, with their free ends, elastically on the inner wall of the bottom container part.

The cartridge is thus held over the elements, supports and curved plates. The number of parts and the space required for this type of support and also for the elastic suspension is quite considerable. The elastic suspension is not very advantageous for the chemical contained in the cartridge in particle form, and the risk of jarring is very great; individual shocks would be less dangerous (German Pat. No. 1,132,802 ).

SUMMARY OF THE INVENTION

The invention provides an oxygen respirator where the cartridge containing the chemical is held jolt-proof in a standby container. The mount requires less space, and the replacement of the spent cartridge is simple.

This invention includes a holding element which can be pressed safely between the chemical cartridge and the side wall of the standby container. It snaps-in with its support and holds the chemical cartridge jolt-proof. The number of holding elements required depends on the form of the chemical cartridge. With a symmetrical design, four holding elements will always be sufficient. The space requirement is small. Detachment of the cartridge for replacing the chemical cartridge is simple and can be effected with a screwdriver while is always available.

The design of the holding element as a plastic molded part also permits its use in small apparatus. The material is elastic, so that it can follow existing forms.

Accordingly, it is an object of the invention to provide an oxygen respirator container which comprises a cylindrical bottom part having a bottom wall and an interior side wall with a plurality of spaced apart raised ribs with a recess defined between adjacent ribs, and including an oxygen generating cartridge disposed in the bottom part on said bottom wall and over said ribs of said side wall with at least one holding element disposed in the recess between adjacent ribs between the container and the side wall and having a top head portion projecting outwardly from the holding element into the bottom part and overlying the top edge of the cartridge and holding the cartridge over said bottom wall and wherein the side wall of the container has an indented part adjacent the top of the cartridge with a top ledge defining a holding nose and the holding element includes a deflectable tab portion engageable under the nose.

A further object of the invention is to provide an oxygen respirator container which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
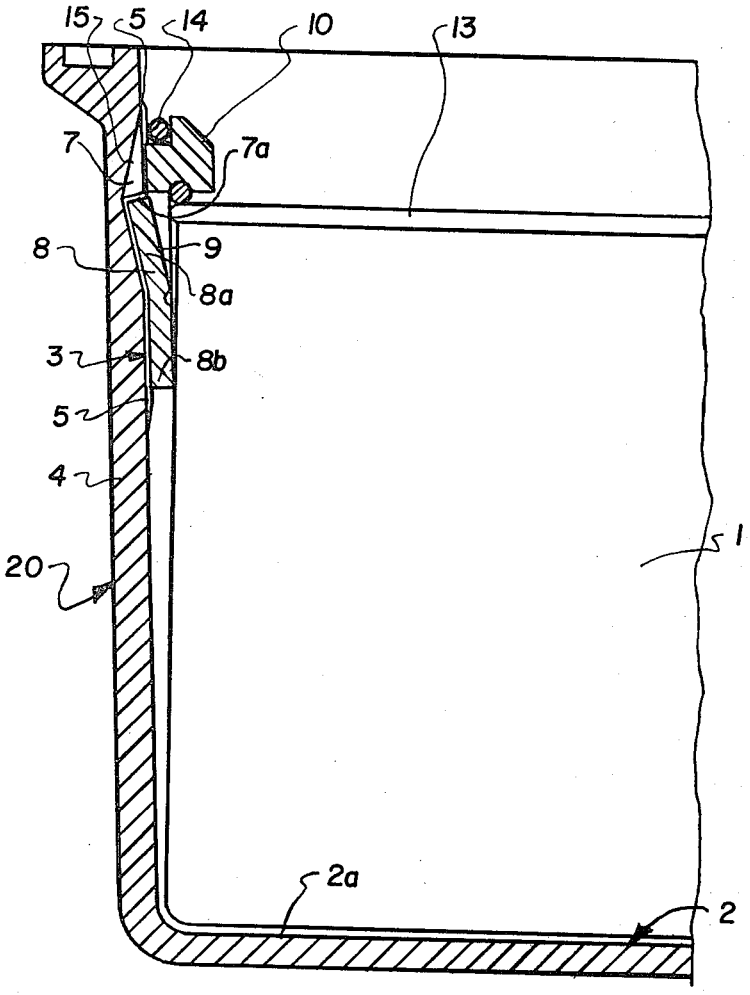
FIG. 1 is a partial transverse sectional view of a container having a chemical cartridge held therein and constructed in accordance with the invention.

Referring to the drawings in particular, the invention embodied therein comprises an oxygen respirator container generally designated 20 which comprises a cylindrical bottom part generally designated 2 which includes a bottom wall 2*a* and an interior side wall 4 having a plurality of spaced apart raised ribs 5 with a recess 6 defined between adjacent ribs. An oxygen generating cartridge 1 is disposed in the bottom part 2 over the bottom wall 2*a* and over the ribs 5 of the side wall 4. At least one holding element generally designated 3 is disposed in the recess 6 between adjacent ribs 5 and is disposed between the container and the side wall 4. The holding element 3 includes a top head portion 10 which projects outwardly from the holding element into the bottom part and overlies the top edge 13 of the cartridge 1 and holds the cartridge over the bottom wall 2*a* . The wall 4 has an indented part 6 adjacent the top of the cartridge 1 with a top ledge 7 defining a holding nose 7*a*. The holding element has a deflectable tab portion 8*a* which is deflectable into engagement beneath the nose 7*a*.

Figure 2:
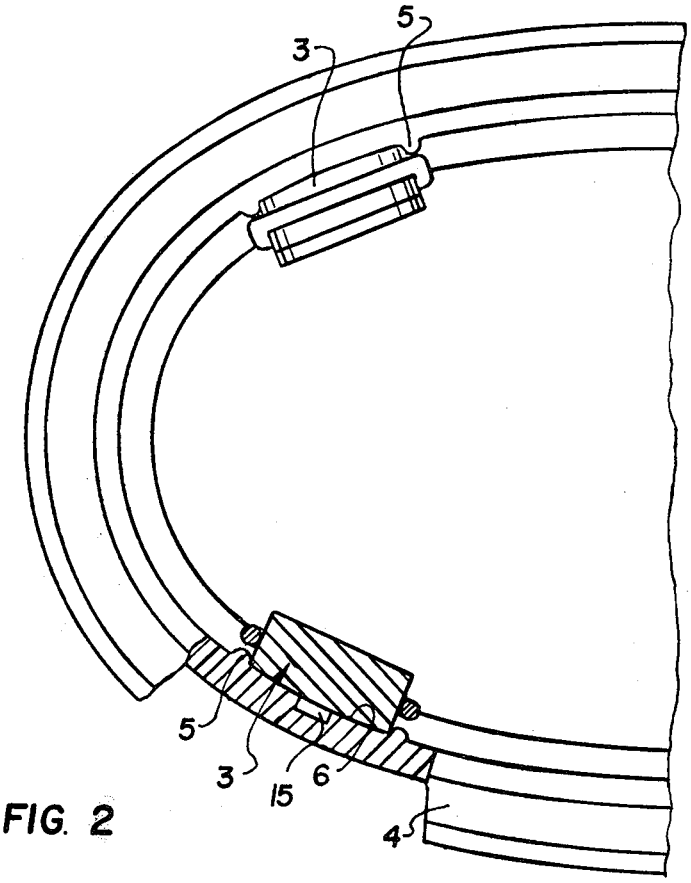
FIG. 2 is a partial top plan view of the container with the cartridge shown in FIG. 1.
Figure 3:
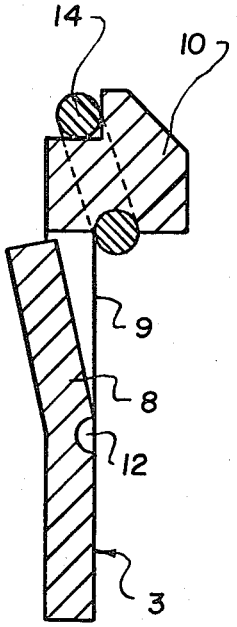
FIG. 3 is an enlarged partial sectional view similar to FIG. 1 showing the holding element.
Figure 4:
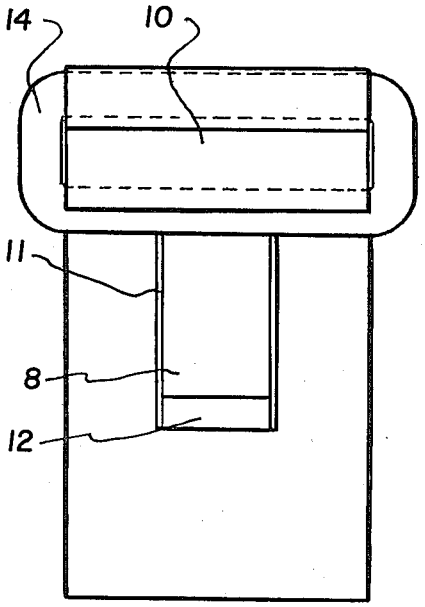
FIG. 4 is a front elevational view of the holding element shown in FIG. 3.

A chemical cartridge 1 is held in a bottom part 2 of a container 20. As shown in FIG. 2, a total of four holding elements generally designated 3 can be arranged on the circumference of chemical cartridge 1. Cartridge jackets or containers 20 of a different shape may require a different arrangement. A space between a side wall 4 and, the bottom container part 2 and the chemical cartridge 1 is fixed by raised ribs 5, which are a part of side wall 4. Between the ribs 5, side wall 4 has an indented part or depression 6 with a catch or ledge 7 defining a holding nose 7*a* under which a deflectable support portion 8*a* of a tab 8 of the holding element 3 extends. The tab 8 includes a straight part 8*b* held by the container against the wall 4.

The holding element 3 is a molded plastic part, according to the shown embodiment of the invention and comprises a wedge piece 9 with a head 10. Wedge piece 9 contains a support 8 projecting from a window or cut out 11. The support 8 can be pressed elastically into the window 11 over a film hinge 12. Head 10, with holding element 3 inserted, extends over an underlying upper edge 13 of the chemical cartridge 1 and holds the cartridge in the bottom part 2 of the container 20. Tolerances are equalized by an O-ring 14 which is arranged in a groove defined around the head 10. The holding element 3 is introduced into the bottom part 2 by pressing it simply between ribs 5 into the interval between the inner side of side wall 4 and chemical cartridge 1. The support 8 moves elastically into the window 11, jumps then back into depression 6, and is supported under the catch 7.

For loosening holding element 3, a recess or slot 15 is provided toward the opening of bottom part 2 of the width of a screwdriver.

By inserting a screwdriver into the recess 15, the support 8 can be bent out from under catch 7 and holding element 3 can then be removed.

While specific embodiments of the invention have been shown and described in detail to illustrate the application of the principles of the invention, it will be understood that the invention may be embodied otherwise without departing from such principles.

What is claimed is:

1. An oxygen respirator container comprising a cylindrical bottom part having a bottom wall, and an interior side wall with a plurality of spaced apart raised ribs on said side wall defining a recess between adjacent ribs, an oxygen generating cartridge disposed in said bottom part on said bottom wall and over said ribs of said side wall, and at least one holding element disposed in said recess between adjacent ribs between said side wall and said container and having a top head portion projecting outwardly from said holding element towards the center of the bottom part and overlying the top edge of said cartridge and holding said cartridge over said bottom wall, said side wall having an indented part adjacent the top of said container in said recess with a top ledge thereof defining a holding nose, said holding element having a deflectable tab portion engageable under said holding nose.

2. An oxygen respirator container according to claim 1 including an access recess defined in said side wall between said top portion of said holding element and said side wall permitting insertion of a loosening tool for said holding element.

3. An oxygen respirator container according to claim 1 wherein said head portion includes a groove defined therearound and including a O-ring disposed in said groove sealing said holding element with the top of said cartridge.

4. An oxygen respirator container according to claim 1 wherein said tab portion includes a film hinge hinging it to the remainder of said holding element, said holding element having a window portion defining the outline of said tab portion and the tab portion including an upper portion bendable into said indented portion and a lower portion held by said container against said side wall.

5. An oxygen respirator container according to claim 4, wherein said holding element comprises a molded plastic part.

6. An oxygen respirator container according to claim 1, wherein said indented portion is defined between adjacent ribs.

7. An oxygen respirator container according to claim 2, wherein said access slot is of a width equivalent to a screwdriver.

* * * * *